US005085398A

United States Patent [19]

Holcomb et al.

[11] Patent Number: 5,085,398

[45] Date of Patent: Feb. 4, 1992

[54] ADJUSTABLE FORM BRACE

[76] Inventors: Grove R. Holcomb, 1135 Pine Ridge Dr.; Bruce M. Douglas, 4370 Bridle Way, both of Reno, Nev. 89509

[21] Appl. No.: 679,812

[22] Filed: Mar. 29, 1991

Related U.S. Application Data

[60] Continuation of Ser. No. 412,848, Sep. 26, 1989, abandoned, which is a division of Ser. No. 260,185, Oct. 19, 1988, Pat. No. 4,880,203.

[51] Int. Cl.[5] ..... E04G 11/38; E04G 11/50

[52] U.S. Cl. ..... 249/24; 249/28; 249/211

[58] Field of Search ..... 249/23, 24, 25, 28, 249/211, 219.1; 248/241, 243, 425, 235, 354.5; 254/98, 99, 131, 133 A, DIG. 1

[56] References Cited

U.S. PATENT DOCUMENTS

| | | | |
|---|---|---|---|
| 1,901,726 | 3/1933 | Bonnet | 254/98 |
| 2,511,584 | 6/1950 | Hill | 249/33 |
| 3,165,288 | 1/1965 | Jackson | 248/226 |
| 3,288,499 | 11/1966 | Morrissey | 287/54 |
| 3,313,505 | 4/1967 | Petrie | 248/354.5 |
| 3,642,243 | 2/1972 | Eugene | 254/98 |
| 3,689,018 | 9/1972 | Pelle et al. | 249/13 |
| 3,806,074 | 4/1974 | Ward | 248/228 |
| 3,815,858 | 6/1974 | Mocny et al. | 248/295 |
| 3,861,634 | 1/1975 | Hood et al. | 249/23 |
| 4,083,156 | 4/1978 | Tye | 52/127 |
| 4,583,712 | 4/1986 | Wilks | 254/89 |

*Primary Examiner*—Jay H. Woo
*Assistant Examiner*—Khanh P. Nguyen
*Attorney, Agent, or Firm*—Virginia Shaw Medlen

[57] ABSTRACT

An adjustable brace for supporting an elevated concrete form floor between support beams during the curing of the concrete is provided. The adjustable brace is formed from two legs which are connected together at their top to a cradle assembly such that the legs can move in scissors fashion with relation to each other. The brace also includes a device for adjusting the height of the legs or the height of the cradle or both. In use, the feet of the brace are placed at the web/flange interface of opposing facing support beams while the top of the brace provides support to a shoring member placed beneath the elevated form floor between the support beams.

17 Claims, 2 Drawing Sheets

ADJUSTABLE FORM BRACE

This application is a continuation of copending U.S. Pat. No. 07/412,848 filed Sep. 26, 1989, now abandoned, a division of copending U.S. Pat. application Ser. No. 07/260,185, filed Oct. 19, 1988, U.S. Pat. No. 4,880,203.

TECHNICAL FIELD

The present invention relates to the construction of concrete forms for elevated spans. In particular, the present invention relates to shoring for supporting the floor of a concrete form for an elevated span.

BACKGROUND ART

Elevated concrete spans or decks are necessary in the construction of bridges, multi-story buildings, and other structures such as culverts and falsework applications. Such spans are often constructed on site. In order to construct such spans, concrete forms are built between two or more adjacent support beams or girders. The concrete form floor can be constructed from corrugated metal sheets (referred to in the art as "stay in place" or "SIP" decking) or other materials such as plywood which are placed on and extend between the two adjacent support beams or girders. The distance between the adjacent support beams determines to a large extent the characteristics of the material used to construct the form floor. Where the distance between the adjacent support beams is relatively small, thinner form floor materials can be used by simply placing the form floor materials across the support beams. If the distance between the support beams is increased, and the ability of the form floor to support the weight of the concrete is exceeded, the builder must decide whether to use thicker form floor material, which is more expensive than thinner materials, or to use additional means for supporting the bottom of the form floor.

The use of additional support for the form floor has been particularly desirable when using SIP decking in view of the high cost difference between the thin and thick corrugated tin. In the past, however, the cost of providing the additional support necessary to be able to use thin SIP decking was also very high. Because each bridge, building or other structure is unique in many aspects, not the least of which is in the number of and spacing between span support beams, it has been necessary to construct special timber bracing for supporting a shoring timber placed between the span support beams for supporting the center of the form floor. Because the timbers for the bracing are cut to size and fitted depending upon the dimensions of the particular bridge, they generally cannot be reused. Further, a significant element of the cost of providing the additional support arises from the many manhours required to cut the timbers, construct the bracing, and disassemble when the job is completed. Therefore, the need exists for a reusable form brace which can be used to support a shoring member at the center of the form floor, which is adjustable to permit use in many different environments, and which is easy to erect and disassemble.

SUMMARY OF THE INVENTION

The present invention provides a reusable form brace for providing support for the central region of a concrete span form floor which is easy to erect and disassemble.

In one embodiment, the present invention provides a brace including two legs each having a top and a bottom portion. The legs are adjustable in length and are attached together at their top portions to enable the legs to pivot scissors-like about the point of attachment to increase or decrease the distance between the two bottoms. In use, the top portions support a shoring member at or near the center of the form floor and the bottom portions ar adapted to be placed against adjacent span support beams at the facing junctions between the web and the lower flange.

In another embodiment, the bottom portions of each leg includes a means for adjusting the height of the brace.

In yet another embodiment, the upper portion of the brace includes a means for adjusting the height of the brace.

In yet another embodiment, the present invention provides a brace comprised of two non-adjustable legs constructed from lumber and cut to size, a cradle assembly having sockets adapted to receive the upper portion of the non-adjustable legs and including a means for adjusting the height of the brace, and two feet adapted to receive the bottom portion of the nonadjustable legs.

In yet another embodiment, the brace includes a means for limiting the distance between the bottom portions of the legs to a maximum and a minimum distance consistent with safe operation.

Other and further embodiments and modifications will become apparent upon a review of the detailed description in conjunction with the drawings.

DETAILED DESCRIPTION

Figures 1, 2, 3, 4:
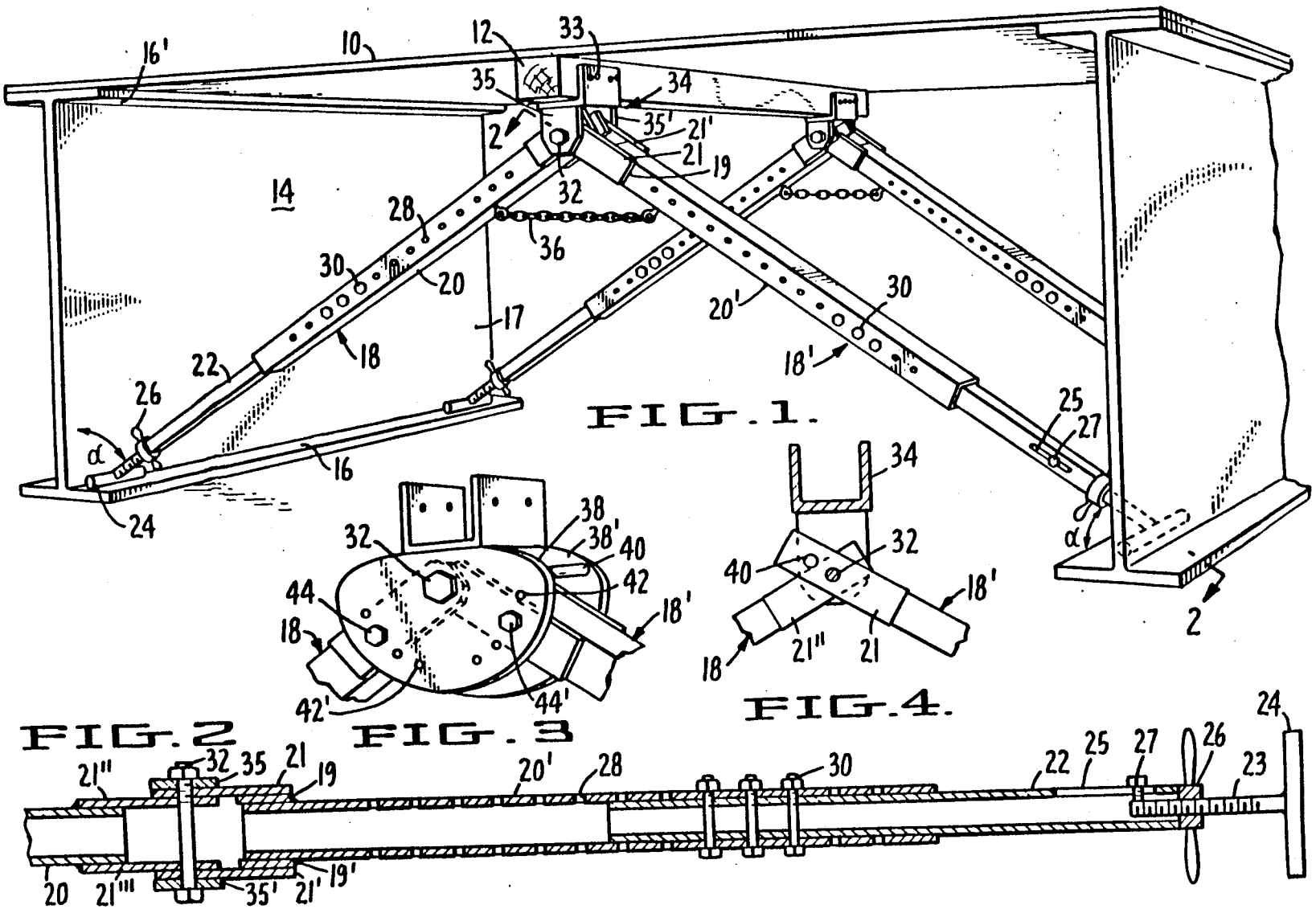
FIG. 1 is a perspective frontal view of braces of the present invention in use supporting a shoring member placed beneath a corrugated metal form floor, in which height adjustments are made at the legs and at the feet.
FIG. 2 is a sectional view taken through line 2—2 of FIG. 1.
FIG. 3 is a perspective view of the upper portion of a brace of the present invention showing an alternative means for limiting the angle between the two legs.
FIG. 4 is a sectional view of the upper portion of a brace of the present invention showing an alternative means for limiting the angle between the two legs.

Bridges, some buildings and other elevated structures can be built by placing two or more substantially parallel support beams 14 on foundation members (not shown) for the entire length of the bridge. Such support beams 14 are typically heavy, rolled steel "I" beams or plate girders having an upper flange 16', a lower flange 16 and a web 17. A concrete form, including form floor 10, is then constructed between the support beams 14. Form floor 10 is typically constructed from SIP decking which can be left in place after the bridge is completed, or from plywood which can be stripped after the bridge is completed. If the material used to construct form floor 10 is not sufficiently strong to support the poured concrete without sagging or failing altogether, support will be needed to shore up the central region of form floor 10. In such event, one or more shoring timbers or members 12, are used to provide continuous support to the form floor 10 between the support beams 14. The shoring members 12 are supported in position beneath the central region of the elevated form floor 10 using adjustable braces of the present invention. Although only two such braces are illustrated in FIG. 1, one of ordinary skill in the art will recognize at once that many such braces will be required, with typical spacing between such braces ranging from about 4 feet to about 20 feet depending upon the distance between support beams 14, the thickness of the elevated form floor 10, the amount of concrete to be supported during curing, and other factors such as the angle between the two legs of the brace.

FIGS. 1 and 2 illustrate an adjustable brace of the present invention, including two leg assemblies 18, 18' and a cradle assembly 34. Each leg assembly 18, 18' consists of an upper leg 20, a lower leg 22, a foot 24 connected to a threaded rod 23, and a height adjuster 26. Height adjuster 26 may consist of a handle which contains a threaded receiver or nut for receiving and moving threaded rod 23 when the handle is rotated about threaded rod 23, or it may simply consist of a standard coil nut of appropriate size which is rotatable using a wrench. For example, as shown in FIG. 2, this is done by using a standard coil nut as the threaded receiver, and by placing a longitudinally aligned slot 25 in the wall of the lower leg 22 of sufficient size to receive and retain a small bolt 27 which can be placed near the interior end of the threaded rod 23 to maintain the alignment of the threaded rod 23 and to limit the movement of the threaded rod into or out of the lower leg 22.

Upper leg 20 and lower leg 22 is preferably constructed from square or rectangular steel tubing of a size to permit the lower leg 22 to telescope inside upper leg 20. Although not preferred, telescoping round tubing sections could also be used. Upper leg 20 also includes two flat connector plates 21'', 21''' attached, for example by welding, to opposite sides of the square steel tubing at the upper end of upper leg 20. Upper leg 20' is constructed similarly but preferably also includes spacer plates 19, 19' interposed between each connector plate 21, 21' and upper leg 20' at the upper end of leg 20' to increase the distance between the connector plates 21, 21' to adapt them to accommodate between them the connector plates 21'', 21''' of upper leg 20 as shown more clearly in FIG. 2. The two leg assemblies 18, 18' may then be connected together by "nesting" the plates 21'', 21''' between the plates 21, 21' and connecting them together, for example by using a bolt 32, to permit scissors-like movement of the opposite ends of the two leg assemblies 18, 18' toward and away from each other.

Cooperating holes 28 are preferably drilled through both the upper leg 20 and the lower leg 22 to permit a coarse adjustment in the length of the leg assembly 18. When a particular length for leg assembly 18 is desired, the lower leg 22 is pulled or pushed until the approximate desired length is obtained, the cooperating holes 28 in both the upper leg 20 and the lower leg 22 are aligned, and the position of the lower leg 22 within the upper leg 20 is secured using one or more bolts 30. A final adjustment to the length desired can then be made by rotating height adjuster 26 to move foot 24 towards or away from lower leg 22. These two means of adjusting the height of the leg assemblies 18, 18' are shown in detail in FIG. 2. Because the leg assemblies 18, 18' are independently adjustable, they can be used in situations where the elevation of the flanges of adjacent support beams are different, and different leg lengths will be required to support the shoring member 12 squarely under the form floor 10, or otherwise to shift the location of the supporting cradle assembly 34 to the desired position.

As shown in FIGS. 1 and 2, the two leg assemblies 18, 18' are connected to each other and to the cradle assembly 34 as shown in FIG. 1 by cradle bolt 32, such that the bottom portions of the leg assemblies 18, 18' can be moved in scissors fashion towards or away from each other. This permits a brace of the present invention to be used in a variety of different environments in which the distance between the support beams 14 and the height between the lower flange 16 of the support beam and the elevated form floor 10 varies substantially from one project to the next. The angle $\alpha$ formed between each leg assembly 18, 18' and the lower flange 16 of the support beam 14 in use will typically range from about 20 degrees to about 55 degrees, although a wider range of angles is possible. If a support beam 14 is used which does not have a lower flange 16 on which the foot 24 of the brace rests, then angle $\alpha$ is measured between each leg assembly 18, 18' and the horizontal foundation member on which support beam 14 is placed.

The cradle assembly 34 is preferably formed with a shaped holder 33 of a size and shape for closely holding a shoring member 12. Such shoring members 12 typically range in size from about 4 inches by 4 inches to about 8 inches by 8 inches and can be constructed from wood, metal such as steel, or any other suitable load bearing material. Many variations in holder 33 are possible, and even a simple flat plate attached transversely to the downwardly extending flanges 35, 35' will work. Holder 33 may be provided with one or more holes for nailing or otherwise securing the cradle assembly 34 to the shoring member 12 to prevent the shoring member 12 from accidentally slipping off the brace. Cradle assembly 34 additionally includes two downwardly extending flanges 35, 35' for connecting the connector plates 21, 21', 21'', 21''' of the two leg assemblies 18, 18' to each other as described above and to the cradle assembly 34 by passing bolt 32 through a hole in flange 35, through a similar aligned hole in the connector plate 21 of the leg 20', through similar aligned holes in the connector plates 21'', 21''' of leg 20, through a similar aligned hole in connector plate 21' of leg 20' and out through a similar aligned hole on flange 35', and then by securing the bolt in place, for example by using a nut.

For safety reasons, it may be desirable to prevent a user from opening the leg assemblies too far (decreasing $\alpha$) to the point where failure may occur. This can be done in a variety of ways. FIG. 1 illustrates one embodiment in which the maximum angle between the leg assemblies 18, 18' can be limited by attaching chain 36 between the upper legs 20 of leg assemblies 18, 18'.

FIG. 3 illustrates another embodiment in which broad plates 38, 38' are used in lieu of the flanges 35, 35' of FIG. 1. In addition to providing a means -for connecting leg assemblies 18, 18' together using bolt 32, plates 38, 38' can also be provided with a plurality of holes 42, 42' which correspond with specific degree settings. Leg assemblies 18, 18' can be held at these specific degree settings, if desired, by passing bolts 44, 44' through holes 42, 42' and into a cooperating hole in the connector plates 21, 21'. A user can be prevented from opening the leg assemblies 18, 18' beyond a certain maximum angle by providing a stop bar 40 between the plates 38, 38' FIG. 3 also shows the most preferred method of constructing the connector plates 21, 21', 21'', 21''' in which the upper corners are removed to prevent interference with the top of the cradle assembly as the leg assemblies 18, 18' are moved towards and away from each other.

FIG. 4 illustrates another embodiment in which the flat plates 21, 21' on one leg assembly 18' are fitted with a stop bar 40 which will bear against the top outside edge of the shorter flat plates 21'', 21''' when the legs are at the maximum recommended angle (minimum $\alpha$), thus preventing a further increase in the angle between the leg assemblies 18, 18'.

Figure 5:
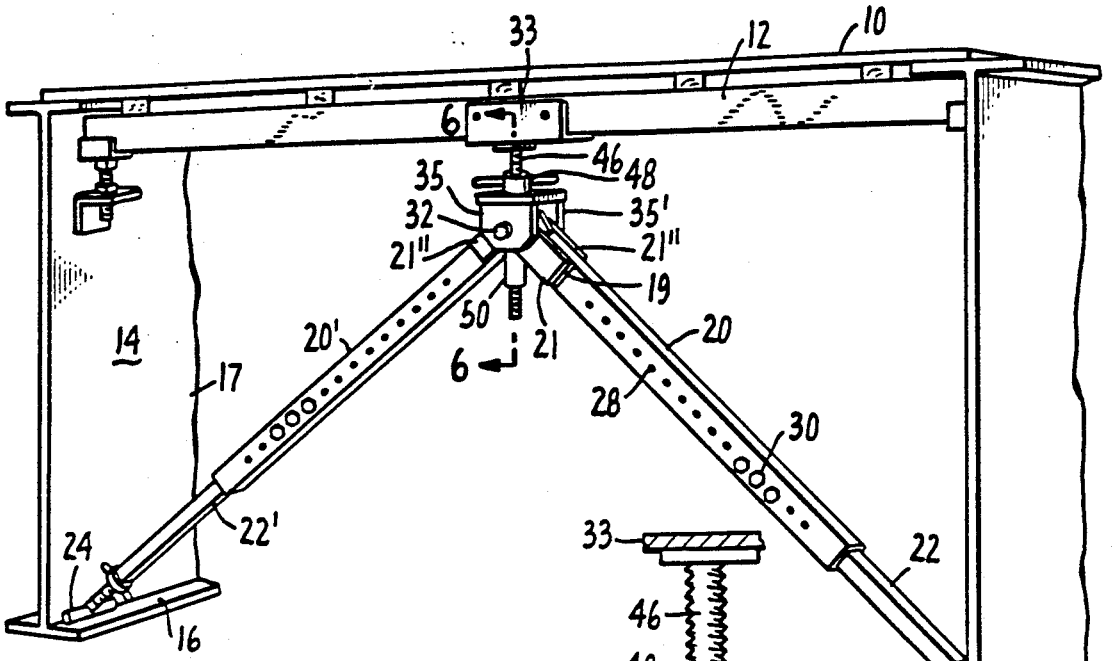
FIG. 5 is a perspective view of a brace of the present invention in use supporting a shoring member placed beneath a removable wooden form floor, in which height adjustments are made at the legs and at the cradle assembly.
Figure 6:
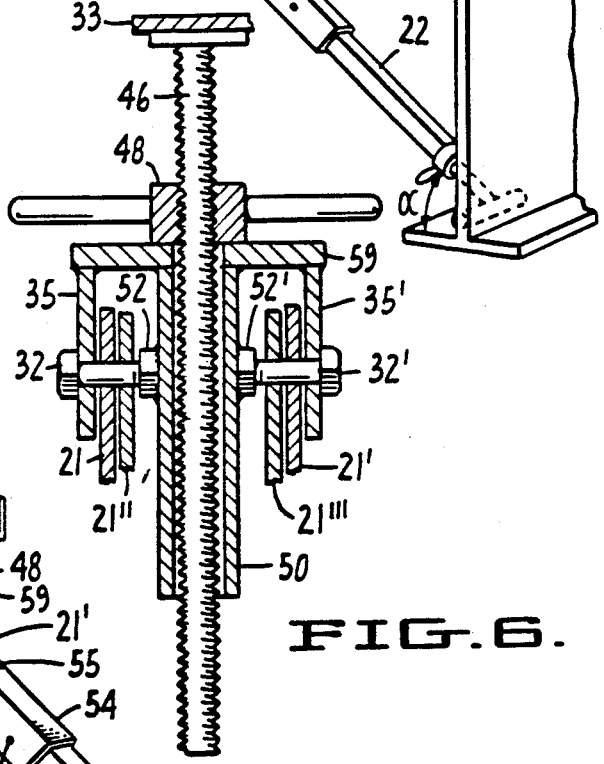
FIG. 6 is a sectional view taken through line 6-6 of FIG. 5.
Figure 7:
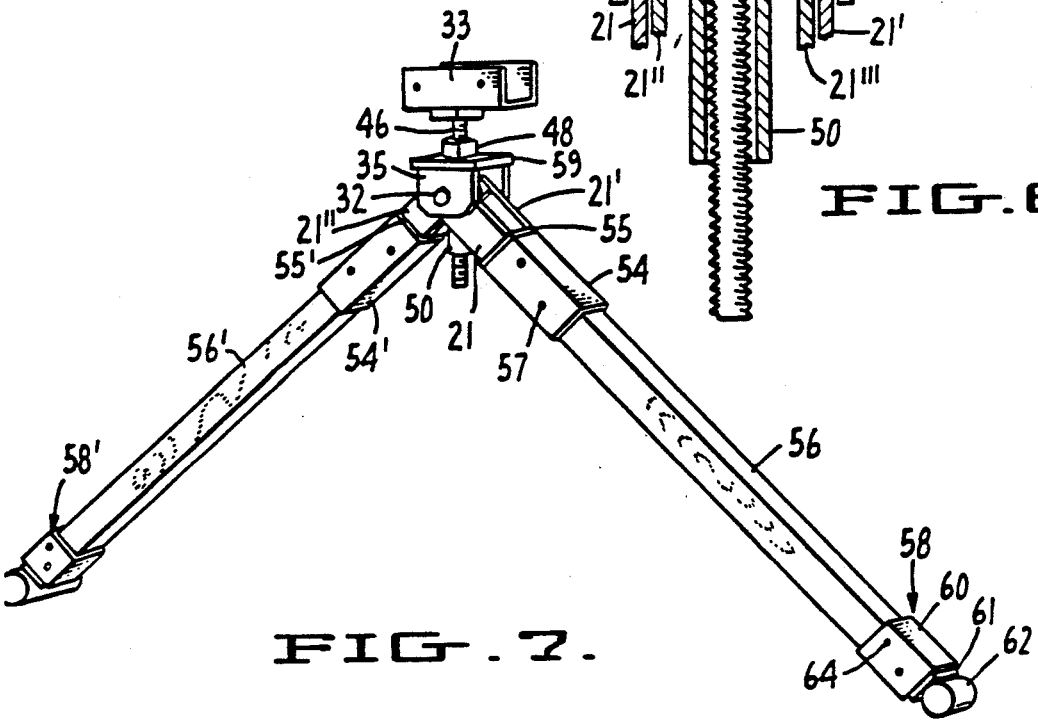
FIG. 7 is a perspective view of a brace of the present invention in which all height adjustments are made at the cradle assembly, thus enabling the use of legs which can be provided from materials located at the work site.

FIGS. 5 and 6 illustrate another, more preferred embodiment of the invention, in which the cradle assembly 34 includes a means for adjusting the height of the brace in use. Although FIG. 5 shows the feet as also being adjustable, this is not necessary and the feet may be fixed as shown in FIG. 7. The gross desired height is calculated and the legs are adjusted to match this length from the foot to the bolt 32 by telescoping as discussed above. The cradle assembly in this embodiment includes a threaded rod 46 and height adjuster 48. Height adjuster 48 may include a handle containing a threaded receiver or nut for receiving and moving threaded rod 46 when the handle is rotated about the threaded rod for adjusting the height of holder 33 relative to the brace, as shown in FIG. 5 or may simply consist of a standard coil nut of appropriate size which can be rotated using a wrench as shown in FIG. 6.

The threaded rod 46 passes between the connector plates 21, 21', 21'', 21''' as shown in FIG. 6. In order to prevent interference with bolt 32, the threaded rod is passed through sleeve 50 to which is attached, for example by welding, threaded receivers 52, 52' which are aligned with the holes in downwardly projecting flanges 35, 35' for receiving a bolt 32, 32' from each side. Thus, in this embodiment, the connector plates 21'', 21''' are nested inside connector plates 21, 21' so that the holes are aligned, a cradle head plate 59 with attached downwardly projecting flanges 35, 35' are placed over the connector plates so that sleeve 50 is positioned between the connector plates and so that the holes in the connector plates and the downwardly extending flanges are aligned with the threaded receivers 52, 52'. Attachment is made by inserting bolt 32 through flange 35, connector plate 21, connector plate 21'' and screwing bolt 32 into threaded receiver 52, and by inserting bolt 32' through flange 35', connector plate 21', connector plate 21''' and screwing bolt 32' into threaded receiver 52'. Fine height adjustment is made by rotating height adjuster 48 to cause the threaded rod 46 to move holder 33 up or down. As this embodiment illustrates, the holder 33 can be constructed to be rotatable about threaded rod 46 to permit the brace to be used to support shoring members 12 in a variety of orientations relative to the support beams 14, for example as shown in FIGS. 1 and 5. The fixed holder 33 shown in FIG. 1 can also be modified to be rotatable.

FIG. 7 shows the most preferred embodiment of the present invention. In this embodiment, the legs are non-adjustable and are preferably constructed from lumber available at the worksite. In this embodiment, relatively cheap and commonly available lumber, such as, for example, 4 inch by 4 inch lumber, 4 inch by 6 inch lumber, and 6 inch by 6 inch lumber, can be used to form the legs for the brace. By using lumber available on the worksite, the user avoids the cost of shipping fully assembled braces to the worksite and need only ship the cradle assembly and foot assemblies disclosed below.

The cradle assembly 34 of this embodiment includes two relatively short sections of rectangular tubing to form leg sleeves 54, 54' to receive the upper ends of the legs 56, 56'. Sleeves 54, 54' are preferably constructed of steel tubing of a size for closely receiving a commonly available size of lumber. Sleeves 54, 54' can be provided with holes 57 for securing the legs 56, 56' within the sleeves 54, 54' by, for example, nailing or bolting. The top portion of each sleeve 54, 54' is partially closed off with a flat plate 55 to which is welded the two connector plates 21, 2'. The connector plates 21, 21' of sleeve 54 are mounted sufficiently apart to permit the connector plates 21'', 21''' of sleeve 54' to fit between them when the brace is assembled as shown. Each connector plate 21, 21', 21'', 21''' is provided with a hole adapted to receive a bolt 32, 32' to permit the sleeves with attached legs to pivot scissors-like when attached together using bolts 32, 32' between the downwardly extending flanges 35, 35' as described more fully above.

Height adjustment is preferably provided in this embodiment by threaded rod 46 which is attached at one end to holder 33 while the other end extends through a threaded receiver in the height adjuster 48, through head plate 59, and through sleeve 50 which is attached to the head plate 59 and passes between the flanges 35, 35' and connector plates 21, 21', 21'', and 21''' Sleeve 50 also provides a threaded receiver 52, 52' on opposing sides aligned so as to receive bolts 32, 32' for attaching the cradle assembly and the sleeves 54, 54' together to permit the scissors-like movement described above.

The legs 56, 56' are preferably constructed from lumber of a size which will closely fit inside the sleeves 54, 54'. The legs 56, 56' can be cut to the desired length at the worksite, and the upper ends fitted into the sleeves 54, 54' and secured in place using nails or bolts driven through the holes 57 and into the legs 56, 56'. The lower end of each of the legs 56, 56' is then preferably fitted with a foot assembly 58.

Foot assembly 58 includes a leg sleeve 60 constructed from rectangular tubing of a size adapted to receive the bottom portion of legs 56, 56', a flat plate 61 closing off the bottom portion of the leg sleeve 60 and a foot 62 attached to flat plate 61 and adapted to be placed at the juncture between the web 17 and the flange 16 of the support beam 14. Sleeve 60 preferably includes holes 64 for securing the foot assembly 58 to the lower end of each leg 56, 56' using, for example, nails or bolts. The shape of the foot 62 may be any shape suitable for holding the brace at the interface between the web 17 and lower flange 16, including the shape shown in FIGS. 1 and in FIG. 7. Although the foot assembly 58 as shown in FIG. 7 does not include a mechanism for adjusting the height of the brace, one could easily modify the structure to provide adjustment as shown in FIGS. 1 and 2 and as described above, if desired.

An adjustable brace of the present invention would be used as follows. The approximate length of each leg assembly (LA) would be determined. First, the distance between the upper and lower flanges 16, less the distance between bolt 32 and holder 33, is calculated and squared ($F^2$). Then, assuming the brace will be used to support a shoring member halfway between the two support beams, the distance between the webs of the two adjacent support beams is calculated and half that distance is squared ($0.5W^2$). The length of each leg assembly (from the foot to the bolt 32) is then determined by taking the square root of the sum of $F^2$ and $0.5W^2$. After the approximate length of each leg assembly is determined, the lower legs 22 are moved relative to the upper legs 24 until the distance from each foot 24 to the bolt 32 are at or slightly less than this length, and then the lower legs 22 are locked in position relative to the upper legs 24 using bolts 30. When nonadjustable wooden legs are used in conjunction with a cradle assembly 34 as shown in FIG. 7, each leg 56 is cut to a size such that when the leg 56 is fitted in the sleeve 54 of the cradle assembly and a foot assembly 58 is attached, the distance from the foot 62 to the bolt 32 will correspond to the calculated length.

Each adjustable brace is then placed in position by placing the shoring member 12 in the shaped holder 33 of the cradle assembly 34, separating the leg assemblies 18, 18', and placing each foot at the intersection of the lower flange 16 and web 17 of facing opposing support beams such that the leg assemblies are positioned transversely to the support beams 14. Final adjustments to the height of the brace can then be made. In the embodiment shown in FIGS. 1 and 2, this final adjustment is made by rotating height adjuster 26 which will move threaded rod 25 into or out of each lower leg 22, moving the foot 24 toward or away from lower leg 22. In the embodiment shown in FIGS. 5–7, this final adjustment is made by rotating height adjuster 48 to move the threaded rod 46 which will move the holder 33 up or down.

The present invention enables the user to fully support the elevated form floor 10 while making any necessary adjustments to insure that the form floor 10 will be properly supported.

The invention may be further understood from a consideration of the following examples. It should be understood, however, that these examples are merely an illustration and are not intended in any way to limit the scope of the claims.

EXAMPLE 1

An adjustable brace of the present invention having adjustable, telescoping legs and adjustable feet as shown in FIGS. 1 and 2 can be constructed from the following materials:

The upper legs 20, 20' are each constructed from a piece of 3/16" thick square steel tubing having the dimensions 2½×2½"×4'10". Each leg 20 is provided with 18 each 9/16 inch diameter holes drilled through two opposing sides of the steel tubing at about 2 inches apart, center to center, beginning about 6 inches from the top end of each upper leg. To upper leg 20' is welded 2 each ⅜"×2½"×0'5" steel spacer plates 19, attaching the plates to opposing sides of upper leg 20' at the top end as shown in FIG. 1. Upper leg 20' is then completed by welding a ⅜"×3"×0'8" steel connector plate to each spacer plate on leg 20'. To leg 20 is welded two identical steel connector plates to opposing sides on the top end of the upper leg 20. Each connector plate is welded so as to extend beyond the upper edge of the upper legs by about 3½ inches. These connector plates are each provided with a 13/16 inch hole centered 1½ inches from the upper end of each connector plate so as to be alignable with the 13/16 inch hole in the other connector plates and with the 13/16 inch hole provided in the downwardly extending flanges 35, 35'.

The lower legs 22, 22' are each constructed from a ¼" thick piece of square steel tube having the dimensions 2"×2"×4'10". Each lower leg is provided with 3 each 9/16 inch diameter holes drilled through two opposing walls of the steel tubing at about 2 inches apart, center to center, beginning about 2 inches from the top end of each lower leg. In addition, a 5/16 inch by 4" slot 25 is provided on one side of each lower leg with the length of the slot aligned with the length of the lower leg, and the bottom of the slot positioned about 1⅞ inches from the bottom end of each lower leg.

A foot 24 for each lower leg is constructed from an 8" length of 2½ inch diameter round steel bar which is welded transversely to the bottom end of a 9 inch long section of 1½ inch diameter 90M continuous coil threaded rod. The threaded rod is provided with a tap for a ¼ inch×¾ inch bolt at a distance of ¾ inch from the top end of the threaded rod. Threaded on the threaded rod is a 1½ inch standard coil nut to serve as a height adjustment handle 26. To attach the foot assembly to the lower leg, the threaded rod is inserted into the bottom end of the lower leg such that the coil nut rests against the bottom end of the lower leg and the tap in the threaded rod is aligned with the slot 25 in the lower leg. A ¼"×¾" hardened steel bolt is then inserted into the tap through the slot and rotated to secure it in place. The coil nut can then be rotated to move the threaded rod into or out of the lower leg and change the distance between the lower leg and the foot.

The cradle assembly is formed by welding two ⅜"×4"×0'4½ steel plates for forming the downward extending flanges 35, 35' to the bottom of a ¼"×6"×1'2¼ steel plate bent to form a shoring timber holder about 4¼" high, 5¾" wide, and 6" deep. The downwardly extending flanges are attached parallel to each other to provide a 4 inch space between the flanges and are each provided with a 13/16 inch hole centered 2 inches from the lower end so as to be aligned with the 13/16 inch holes provided in the connector plates attached to the upper legs.

The upper legs are attached to the cradle assembly as shown in FIGS. 1 and 2 by placing the connector plates 21'', 21''' of the upper leg 20 inside the connector plates 21, 21' of the upper leg 20', and placing the downwardly extending flanges 35, 35' of the cradle assembly over the overlapping upper legs 20, 20', aligning the holes, and inserting a ¾" diameter, 6" long bolt with a 4" shoulder and securing it with a ¾" nut.

Finally, the lower legs and attached feet are assembled with the upper legs and cradle assembly by sliding a lower leg into each upper leg until a desired length is obtained, aligning the holes on each, and inserting three ½ inch diameter, 3½ inch long hardened steel bolts through the aligned holes in the upper leg and lower leg and securing each wih a ½ inch nut.

The height from the bolt 32 to the holder 33 on this brace is about 3 inches. The legs (from the feet to the bolt 32) are adjustable in length from about 5 feet 9 inches to about 8 feet 7 inches. Telescoping can be used to adjust the length by 2 inch increments according to the following chart which is keyed to the holes on the upper leg, with hole #1 being the hole closest to the cradle assembly and hole #18 being the hole closest to the feet:

| Hole # | App. Length |
|---|---|
| 1 | 5'9" (69") |
| 2 | 5'11" (71") |
| 3 | 6'1" (73") |
| 4 | 6'3" (75") |
| 5 | 6'5" (77") |
| 6 | 6'7" (79") |
| 7 | 6'9" (81") |
| 8 | 6'11" (83") |
| 9 | 7'1" (85") |
| 10 | 7'3" (87") |
| 11 | 7'5" (89") |
| 12 | 7'7" (91") |
| 13 | 7'9" (93") |
| 14 | 7'11" (95") |
| 15 | 8'1" (97") |
| 16 | 8'3" (99") |
| 17 | 8'5" (101") |
| 18 | 8'7" (103") |

EXAMPLE 2

For a form floor erected over two parallel 5-foot (60 inch) steel I-beams erected on piers in which the distance between the facing webs is about 11 feet 6 inches (138 inches), the brace constructed in example 1 above would be set up for use as follows. First the approximate leg length would be calculated to be $[(60-3)^2+(0.5(138))^2]^{\frac{1}{2}}=[3249+4761]^{\frac{1}{2}}=89.5$ inches or slightly more than 7 feet 5 inches.

The three bolts which secure the position of the lower leg in each upper leg are removed, the top hole on each lower leg is aligned with the #11 hole on each upper leg, and the three bolts are replaced.

The brace is then placed in position as shown in FIG. 1 such that the first foot is placed at the intersection of the lower flange and web of one I-beam, the second foot is placed at the intersection of the lower flange and web of the other I-beam, and the shaped holder is positioned immediately beneath the shoring member to be supported. The coil nut on each foot is then rotated to increase the height of each leg assembly until the shoring member is fully supported and flush with the bottom surface of the form floor.

EXAMPLE 3

An adjustable brace of the present invention having an adjustable cradle assembly as shown in FIGS. 5–7 and nonadjustable legs as shown in FIG. 7 could be constructed to be used on the job described in Example 2 from the following materials:

The cradle assembly is formed by welding two $\frac{3}{8}''\times4''\times0'3\frac{5}{8}''$ steel plates to the bottom of a $\frac{7}{8}''\times4''\times0'6''$ steel head plate 59 for forming the downwardly extending flanges 35, 35'. The downwardly extending flanges 35, 35'are attached parallel to each other along the 6 inch dimension of the head plate to provide a $4\frac{5}{8}$ space between the flanges and are each provided with a 13/16 inch hole centered $1\frac{1}{2}''$ from the lower end so as to be aligned with the 13/16 inch holes provided in the connector plates attached to the upper leg sleeves. The head plate is provided with a 1-5/16" centered hole. A steel sleeve $1\frac{1}{2}''\times1\frac{1}{2}''\times0.12''\times0'6\frac{1}{2}''$ is welded to the bottom of the head plate aligned with the 1-5/16" hole to provide a conduit for the threaded rod 46. The steel sleeve is provided with two square $\frac{3}{4}''$ nuts welded to opposing sides of the steel sleeve and centered $2\frac{1}{8}''$ from the top of the steel sleeve in order to align the nuts with the 13/16" holes in the downwardly extending flanges.

A holder 33 is formed by welding two $\frac{1}{4}''\times4''\times0'5\frac{3}{8}''$ plates to one $\frac{5}{8}''\times5\frac{3}{4}''\times0'6''$ base plate such that the two smaller plates form the upstanding portions of the holder as shown in FIG. 7 and such that the 4" dimension on the two plates are centered on and attached to the opposing 6" dimensions on the base plate. One end of a $1\frac{1}{4}''$ diameter, 1'4" length of Dayton-Superior, B-12 continuous coil threaded rod 75M is welded to the bottom center of the base plate. A Dayton-Superior B-13 standard $1\frac{1}{4}''$ coil nut is threaded from the other end of the threaded rod and rotated up close to the base plate before the threaded rod is inserted into the cradle assembly through the 1-5/16" hole in the head plate and placed into the steel sleeve.

The upper leg sleeves for the cradle assembly are each formed from 3/16 inch thick square steel tubing having the dimensions $4''\times4''\times1'0''$. Across the top of upper leg sleeve 54 is welded a $\frac{5}{8}''\times3''\times0'5\frac{1}{4}''$ steel plate 55 to close off the opening in the top of sleeve 54, and across the top of upper leg sleeve 54' is welded a $\frac{5}{8}''\times3''\times4\frac{1}{2}''$ steel plate 55' to close off the opening in the top of sleeve 54'. For upper leg sleeve 54', two steel connector plates 21'', 21''', each being $\frac{3}{8}''\times3''\times0'5''$, are placed on the top of the flat steel plate and aligned such that the 3" dimension on the connector plates is welded to the 3" dimension on the flat plate at a distance of $\frac{3}{8}''$ in from the edge. For upper leg sleeve 54, two steel connector plates 21, 21', each being $\frac{3}{8}''\times3''\times0'5''$, are placed on the top of the flat steel plate such that the 3" dimensions coincide and each connector plate is welded 11/32" in from the edge of the flat steel plate. The corners are removed from the upper ends of the steel connector plates, as shown for example in FIG. 3, by removing $\frac{7}{8}''$ along both sides. The leg sleeves are completed by drilling a 13/16" hole through each of the steel connector plates centered between the sides of the steel connector plates and located at a distance of about $3\frac{1}{2}''$ from the top of the steel plate to which the connector plates are welded, and by drilling several 3/16" holes through the walls of the leg sleeves for securing the legs within the leg sleeves by nailing.

The cradle assembly is completed by placing the steel connector plates of leg sleeve 54' inside the steel connector plates of leg sleeve 54, placing the downwardly extending flanges over the nested leg sleeves and the steel sleeve for the threaded rod between the connector plates, aligning the 13/16" holes With the nuts welded to the steel sleeve for the threaded rod, inserting one $\frac{3}{4}''$ A325 hardened steel bolt through flange 35, through connector plates 21, 21''' and into nut 52, and inserting another $\frac{3}{4}''$ A325 hardened steel bolt through flange 35', through connector plates 21'21'' and into nut 52'.

The completed cradle assembly, from the center of the 13/16" hole for the $\frac{3}{4}''$ nut up will add about $4\frac{7}{8}''$ in height to the brace when the threaded rod is completely retracted. The cradle assembly from the center of the 13/16" hole down to the top of the legs will add about $4\frac{1}{8}''$ to the length of the legs.

Two foot assemblies, as shown in FIG. 7, are constructed using two pieces of 3/16" thick square steel tubing having the dimensions $4''\times4''\times0'3''$ to form the foot sleeves. Across the bottom of each foot sleeve is welded a piece of $\frac{1}{4}''$ steel plate having the dimension $3''\times0'4\frac{1}{2}''$ for closing off the open bottom end of the foot sleeve and for mounting the foot. Each foot 62 is constructed from a 4" length of $2\frac{1}{2}''$ diameter round steel bar which is welded on the steel plate so that the foot is centered on the steel plate and the length of the foot is aligned with the $4\frac{1}{2}''$ diameter of the steel plate. This provides a foot assembly which will add about $2\frac{3}{4}''$ to the length of each leg.

The legs will be constructed from $4''\times4''$ lumber cut to the approximate proper length. As discussed more fully above, the approximate length of each leg from the foot up to bolt 32 would be calculated to be $[(60-5)^2+(0.5(138))^2]^{\frac{1}{2}}=[3025+4761\ ]^{\frac{1}{2}}=88.24$ inches or slightly more than 7 feet 4 inches. To determine the proper length of the wooden legs alone, one would subtract from 7 feet 4 inches the sum of 7 inches, the same being the sum of the height added by the feet ($2\frac{3}{4}''$) and the cradle assembly to bolt 32 ($4\frac{1}{8}''$) rounded up to the nearest inch. Thus, the 4×4's should be cut to a length of about 6 feet 9 inches.

To complete the brace, the upper ends of a $4''\times4''\times6'9''$ leg would be placed into each upper leg sleeve 54 and secured in place using nails driven through the 3/16" holes provided in each upper leg sleeve. A foot assembly would be fitted over the lower end of each leg and secured in place using nails driven through 3/16" holes provided in each foot sleeve.

The brace is then placed in position as shown in FIG. 1 such that the first foot is placed at the intersection of the lower flange and web of one I-beam, the second foot is placed at the intersection of the lower flange and web of the other I-beam, and the shaped holder is positioned immediately beneath the shoring member to be supported. The coil nut on the cradle assembly is then rotated to increase the height of the holder until the shoring member is fully supported and flush with the bottom surface of the form floor.

One skilled in the art will recognize at once that it would be possible to construct the various components of the present invention from a variety of materials and to modify the placement of the components in a variety of ways. While the preferred embodiments have been described in detail and shown in the accompanying drawings, it will be evident various further modifications are possible without departing from the scope of the invention as embodied in the claims.

We claim:

1. An elevated concrete forming apparatus comprising:

a first support beam and a second support beam, said second support beam positioned substantially parallel to and spaced away from said first support beam;

a form floor suspended between said first and second support beams, said form floor having a top surface and a bottom surface;

a shoring member placed against the bottom surface of said form floor between said first and second support beams;

at least one adjustable brace for supporting said shoring member, said brace having:

a first leg and a second leg, each said leg having an upper portion and a lower portion, a fastening means for attaching together the upper portions of the first and second legs for permitting pivotal movement of the lower portions of the legs in a single plane, a supporting means attached to said fastening means for supporting said shoring member, and, a height adjusting means for adjusting the vertical position of said supporting means relative to said concrete form floor;

said lower portion of said first leg being placed against said first support beam and the lower portion of said second leg being placed against said second support beam, and said supporting means being placed against said shoring member, for distributing in a single plane substantially perpendicular to the first and second support beams a compressive load received from the shoring member when concrete is poured onto the top surface of the form floor.

2. The forming apparatus of claim 1 in which said height adjusting means is adapted to change the distance between the supporting means and the fastening means.

3. The forming apparatus of claim 2 in which said height adjusting means of the brace comprises a plate attached to the fastening means, a threaded rod having a first and second end, said first end of said threaded rod being attached to the supporting means and said second end of said threaded rod passing through said plate, and a threaded receiver positioned on said threaded rod between said first end of said threaded rod and said plate such that when said threaded receiver is rotated in one direction the supporting means is moved away from the fastening means and such that when the threaded receiver is rotated in the opposite direction, the supporting means is moved toward the fastening means.

4. The forming apparatus of claim 3 in which said plate has a bottom portion and a top portion, said height adjusting means additionally including a conduit having an interior and an exterior and attached to the bottom portion of said plate to permit the threaded rod to move axially through the conduit, and said exterior of the conduit providing a receiving means for receiving the fastening means.

5. The forming apparatus of claim 1 in which said height adjusting means comprises providing said first and second legs with an inner and an outer telescoping portion for adjusting the length of said legs.

6. The forming apparatus of claim 1 in which said brace additionally has a first foot attached to the lower portion of said first leg, and a second foot attached to the lower portion of said second leg, said first foot adapted to be placed against said first support beam and said second foot adapted to be placed against said second support beam.

7. The forming apparatus of claim 6 in which said height adjusting means is adapted to change the distance between each said foot and the lower portion of the leg to which each said foot is attached.

8. The forming apparatus of claim 7 in which said height adjusting means comprises a threaded rod attached to each said foot and a coil nut threaded onto said threaded rod, said coil nut being rotatably attached to the lower portion of each leg such that the distance between each said foot and the lower portion of the leg to which each said foot is attached is increased by rotating said coil nut in one direction and decreased by rotating said coil nut in an opposite direction.

9. In an elevated concrete forming apparatus wherein a concrete form deck is supported between a first and a second support beam, said second support beam positioned substantially parallel to and spaced away from said first support beam, said concrete form deck having a top surface and a bottom surface, the improvement comprising:

at least one adjustable brace for supporting said form floor between said first and said second support beams, said brace having a first leg and a second leg, each said leg having an upper portion and a lower portion, a fastening means for attaching together the upper portions of the first and second legs, and for permitting pivotal movement of the lower portions of the first and second legs in the same plane, a supporting means attached to said fastening means for supporting said concrete form deck, and, a height adjusting means for adjusting the vertical position of said supporting means relative to the bottom surface of said concrete form deck;

said lower portion of said first leg being placed against said first support beam and the lower portion of said second leg being placed against said second support beam, with said supporting means supporting the bottom surface of said concrete form deck, for distributing in a single plane substantially perpendicular to the first and second support beams a compressive load received from the concrete form deck when concrete is poured onto the top surface of the concrete form deck.

10. The elevated concrete forming apparatus of claim 9 additionally comprising a shoring member placed between the supporting means and the bottom surface of the concrete form deck.

11. The forming apparatus of claim 9 in which said height adjusting means is adapted to change the distance between the supporting means and the fastening means.

12. The forming apparatus of claim 11 in which said height adjusting means of the brace comprises a plate attached to the fastening means, a threaded rod having a first and second end, said first end of said threaded rod being attached to the supporting means and said second end of said threaded rod passing through said plate, and a threaded receiver positioned on said threaded rod between said first end of said threaded rod and said plate such that when said threaded receiver is rotated in one direction the supporting means is moved away from the fastening means and such that when the threaded receiver is rotated in the opposite direction, the supporting means is moved toward the fastening means.

13. The forming apparatus of claim 12 in which said plate has a bottom portion and a top portion, said height adjusting means additionally including a conduit having an interior and an exterior and attached to the bottom portion of said plate to permit the threaded rod to move axially through the conduit, and said exterior of the conduit providing a receiving means for receiving the fastening means.

14. The forming apparatus of claim 9 in which said height adjusting means comprises providing said first and second legs with an inner and an outer telescoping portion for adjusting the length of said legs.

15. The forming apparatus of claim 9 in which said brace additionally has a first foot attached to the lower portion of said first leg, and a second foot attached to the lower portion of said second leg, said first foot adapted to be placed against said first support beam and said second foot adapted to be placed against said second support beam.

16. The forming apparatus of claim 15 in which said height adjusting means is adapted to change the distance between each said foot and the lower portion of the leg to which each said foot is attached.

17. The forming apparatus of claim 16 in which said height adjusting means comprises a threaded rod attached to each said foot and a coil nut threaded onto said threaded rod, said coil nut being rotatably attached to the lower portion of each leg such that the distance between each said foot and the lower portion of the leg to which each said foot is attached is increased by rotating said coil nut in one direction and decreased by rotating said coil nut in an opposite direction.

* * * * *

UNITED STATES PATENT AND TRADEMARK OFFICE

CERTIFICATE OF CORRECTION

PATENT NO. : 5,085,398

DATED : 02/04/92

INVENTOR(S) : HOLCOMB ET AL.

It is certified that error appears in the above-identified patent and that said Letters Patent is hereby corrected as shown below:

In column 6, Line 35, place period after --21'''--.

In column 7, line 54, replace --2-1/2-- with --2-1/2"--.

In column 8, line 35, replace --0'4½-- with --0'4-1/2"--.

In column 8, line 37, replace --1'2¼-- with --1'2-1/4"--.

In column 8, line 51, replace --4"-- with --4-3/4"--.

In column 9, line 58, replace --$4\frac{5}{8}$-- with --4-5/8"--.

In column 10, line 49, replace --With-- with --with--.

In column 10, line 54, replace --21'-- with --21', --.

Signed and Sealed this

Twelfth Day of April, 1994

Bruce Lehman

BRUCE LEHMAN

*Commissioner of Patents and Trademarks*

*Attest:*

*Attesting Officer*